United States Patent [19]

Sieghartner

[11] 3,963,371

[45] June 15, 1976

[54] MULTI-STAGE PUMP

[75] Inventor: Leonard J. Sieghartner, Coal Valley, Ill.

[73] Assignee: Roy E. Roth Company, Rock Island, Ill.

[22] Filed: July 24, 1975

[21] Appl. No.: 598,564

[52] U.S. Cl. ..... 415/199 T; 415/213 T; 415/201

[51] Int. Cl.[2] ..... F04D 29/42

[58] Field of Search ..... 415/53 T, 201, 198 T, 415/199 T, 213 T, 126; 412/219 C, 219 B

[56] References Cited

UNITED STATES PATENTS

| | | | |
|---|---|---|---|
| 2,420,556 | 5/1947 | Mueller | 415/213 T |
| 2,468,246 | 4/1949 | Thayer | 415/199 T |
| 2,900,112 | 8/1959 | Edwards | 415/201 |
| 2,936,714 | 5/1960 | Balje | 415/213 T |
| 3,154,020 | 10/1964 | Sieghartner | 415/199 T |
| 3,168,871 | 2/1965 | Sieghartner | 415/113 |

FOREIGN PATENTS OR APPLICATIONS

| | | | |
|---|---|---|---|
| 64,993 | 10/1955 | France | 415/53 T |
| 378,662 | 7/1923 | Germany | 415/201 |
| 262,458 | 2/1928 | United Kingdom | 415/201 |

*Primary Examiner*—Henry F. Raduazo
*Attorney, Agent, or Firm*—Johnson, Dienner, Emrich & Wagner

[57] ABSTRACT

The segmented casing has a plurality of successive stage casing rings, a transfer plate intermediate each adjacent pair of casing rings, a suction end casing section, and a discharge end casing section. A shaft extends axially through the casing, and is supported and sealed at its ends by demountable bearing and seal means. Each casing ring encloses a complete stage containing an impeller which is spring biased into engagement with a locating collar secured to the shaft, and a pair of replaceable liners which are arranged at the opposite sides of each impeller. Each casing ring, impeller, set of liners, locating collar, and spring means, together comprises a module which functions as one stage of the pump. A pump is comprised of two or more modules which are connected internally by a shaft and externally by draw bolts, and which are contained by the suction and discharge end casing sections. Suction and discharge connections are demountably secured to the casing in any one of several rotative positions.

19 Claims, 21 Drawing Figures

20
22
24
32
34
36
48
104
112
120
121
132
136
138
218
220
224
244
258
3.
3A.

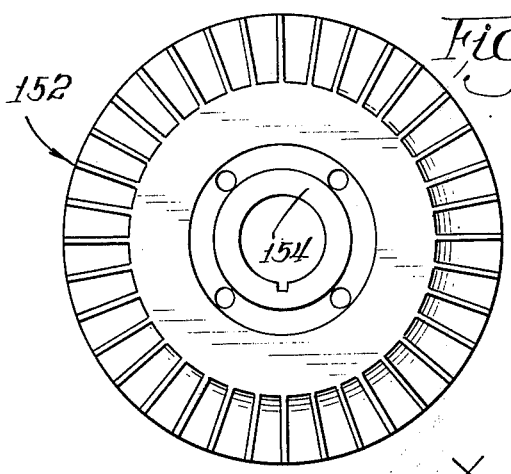
Fig. 14
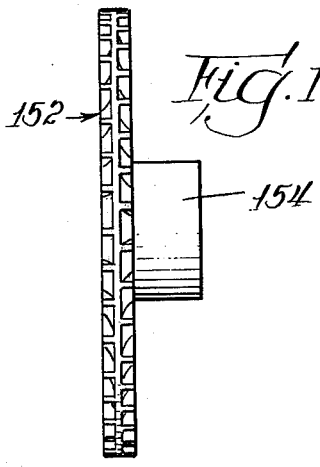
Fig. 15
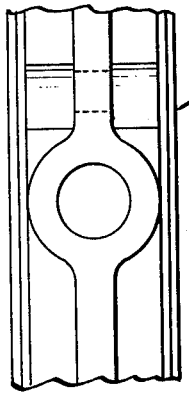
Fig. 11
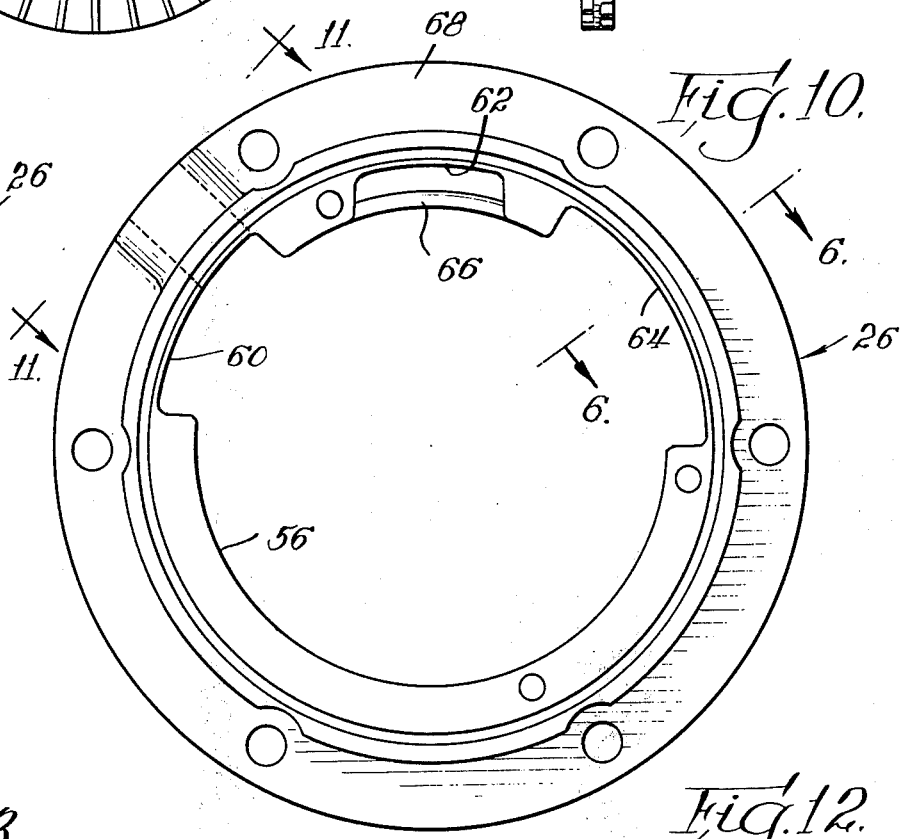
Fig. 10.
Fig. 13.
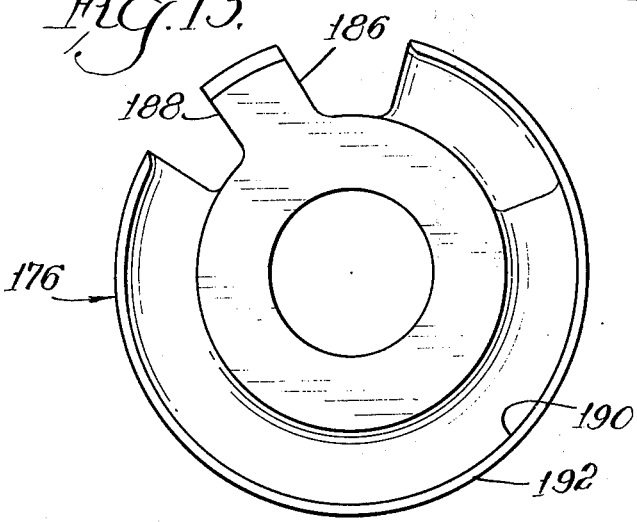
Fig. 12.
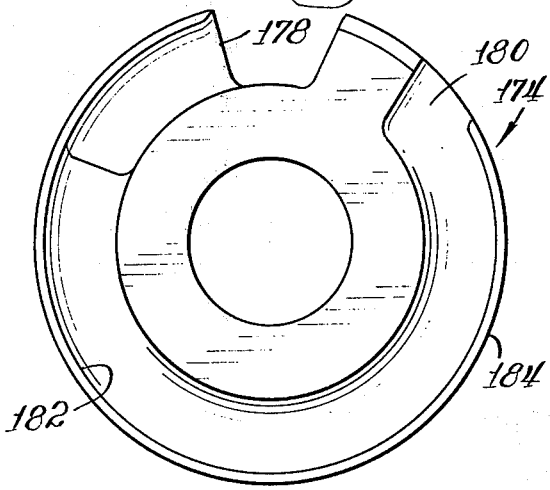

30
32
28
112
104
182
190
250
248
242
230
240
256
264
254
224
244
140
258
234
226
228
144
236
238
262
138
252
246
222
258
156
112
104

MULTI-STAGE PUMP

BACKGROUND OF THE INVENTION

1. Field of the Invention

The present invention relates generally to a high pressure multi-stage pump which is especially adapted for pumping feedwater and the like, and wherein at each stage a differential pressure is developed by a regenerative turbine impeller.

2. Description of the Prior Art

A conventional high pressure regenerative pump comprises a main casing body, end bells, a shaft, an impeller at each stage, and liners at the opposide sides of each impeller.

Heretofore, interconnecting passages and suction and discharge connections have been integral with the main casing body, while the shaft bearing holders have been integral with the end bells (bearing brackets). As a consequence, the casing body and end bells have been of intricate design requiring complicated castings and machining to precise tolerances, and each variation in the number of stages required a new casting. Moreover, axial adjustment of the shaft, the impellers and the liners has been difficult; and excessive wear of the impellers and liners has been experienced. Also, replacement of end bearings and seals has required disconnection of the pump from the associated suction and discharge piping, and disassembly of the end bells. Additionally, coupling of the suction and discharge connections to suction and discharge piping, and decoupling of the pump, have not been as convenient as might be desired. Finally, primarily because of impeller positioning problems, high pressure regenerative pumps have been limited to no more than two stages.

SUMMARY OF THE INVENTION

The multi-stage high pressure regenerative turbine pump of the present invention is comprised of modular components which are of simple design and which are convenient and inexpensive to fabricate. The modular components may be used in the assembly of different pumps with an infinite number of stages.

The pump of the present invention comprises a casing having a plurality of successive-stage casing rings. A transfer plate is in intermediate abutment with each adjacent pair of casing rings, and has fluid passageway means presenting an entrance communicating with the interior of the earlier-stage casing ring and an exit communicating with the interior of the later-stage casing ring. A suction end casing section abuts the first-stage casing ring, a discharge end casing section abuts the last-stage casing ring, and the casing elements are suitably secured together. A shaft extends axially through the casing, and an impeller is keyed thereto within the confines of each of the casing rings.

In addition, liners are provided at the opposite sides of each impeller; they are separate from the casing, and are readily replaceable. Each impeller is spring biased against a locating collar secured to the shaft; this arrangement, while allowing emergency shifting of the impellers, minimizes wear of the impellers and liners. Bearing and seal holders are secured to the end casing sections adjacent the ends of the shaft; they are separate from the end casing sections, and are readily demountable to permit replacement of the shaft bearing and seal means without disturbing other elements of the pump. Suction and discharge connections are secured to the end casing sections; they are separate, and demountable, from the end casing sections; they can be each set in any of several different positions to accommodate different directions of suction and discharge piping; and the pump may be withdrawn from between the connections without disturbing the couplings of the latter to the suction and discharge pipes.

BRIEF DESCRIPTION OF THE DRAWINGS

FIG. 3A is a longitudinal sectional view taken substantially along the line 3A—3A in FIGS. 1 and 7 looking in the direction indicated by the arrows;

FIG. 10 is a side elevational view of a casing ring;

FIG. 11 is a partial edge elevational view taken substantially along the line 11—11 in FIG. 10 looking in the direction indicated by the arrows;

FIG. 12 is a side elevational view of one of a cooperating pair of liners;

FIG. 13 is a side elevational view of the other of a cooperating pair of liners;

FIG. 14 is a side elevational view of an impeller;

FIG. 15 is an edge elevational view of the impeller of FIG. 14;

DESCRIPTION OF THE PREFERRED EMBODIMENTS

Figures 1, 2:
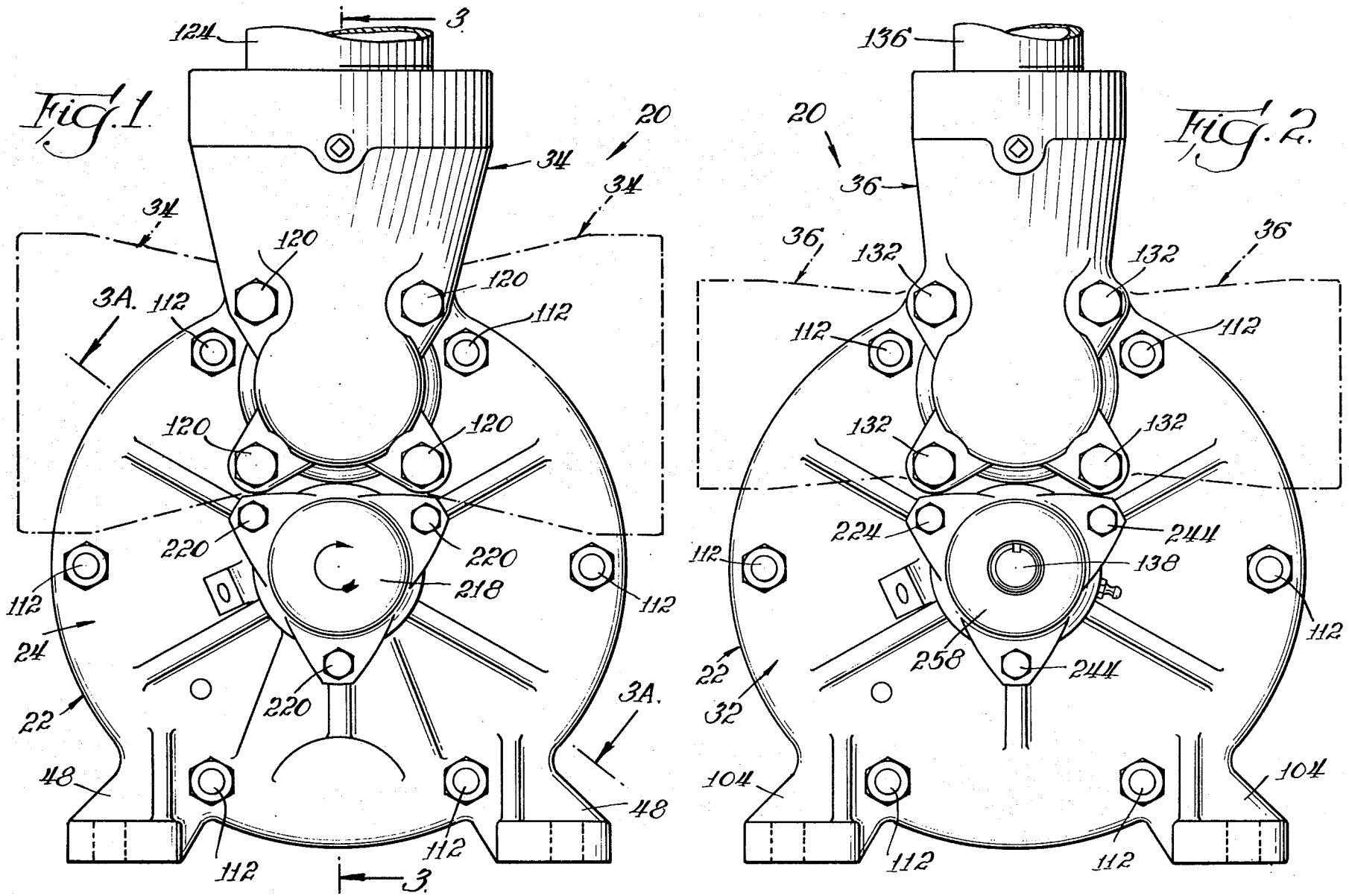
FIG. 1 is an elevational view of the suction end of a two-stage pump incorporating the principles of the present invention.
FIG. 2 is an elevational view of the discharge end of the pump of FIG. 1.
Figure 3:
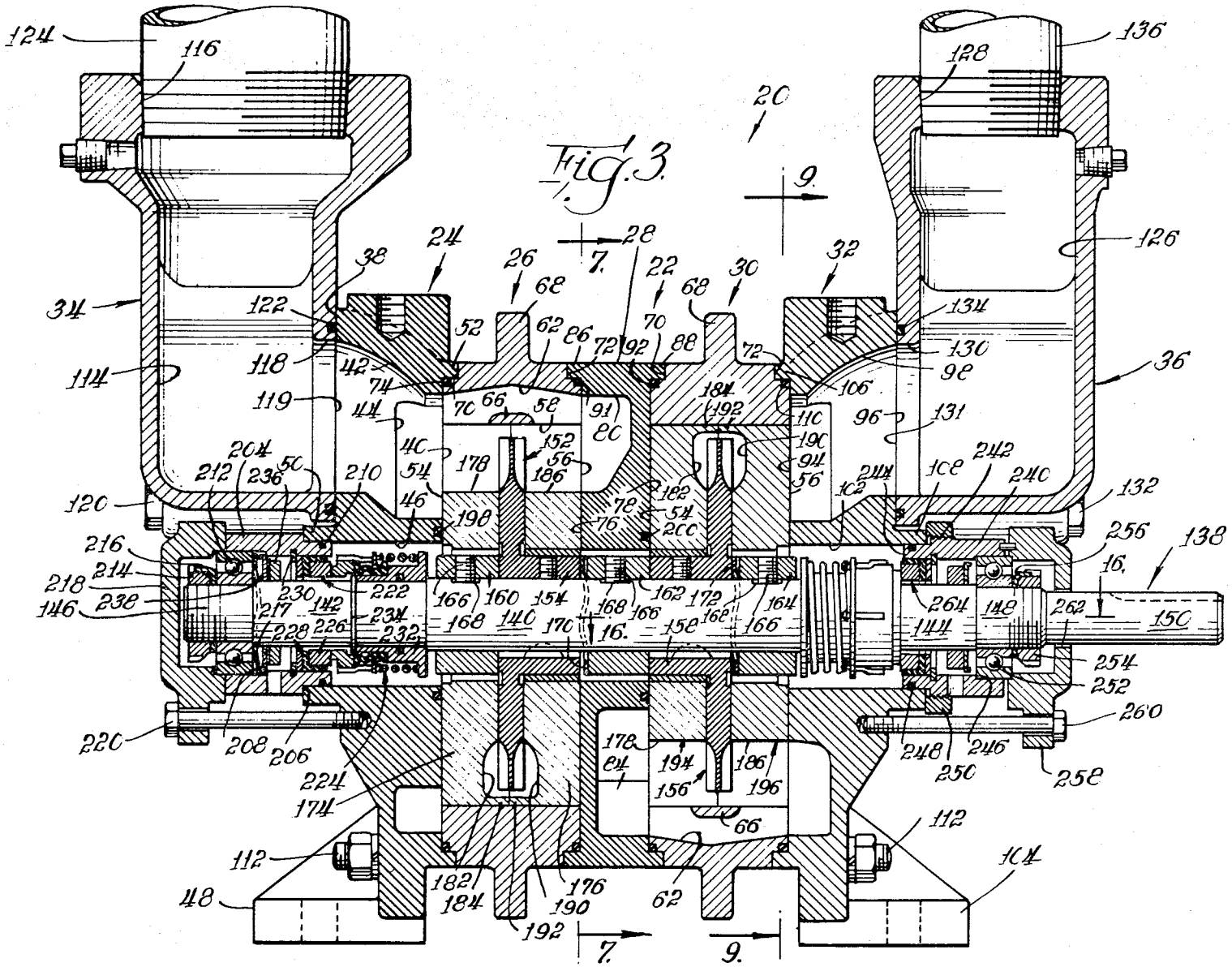
FIG. 3 is a longitudinal sectional view taken substantially along the line 3—3 in FIGS. 1 and 7 looking in the direction indicated by the arrows.

Referring now to FIGS. 1, 2 and 3, there is indicated generally by the reference numeral 20 a two-stage high pressure regenerative turbine pump embodying the principles of the present invention.

The pump 20 includes a casing or housing 22 comprised of a suction and casing section 24, a first-stage casing ring 26, a transfer plate 28, a second-stage casing ring 30, and a discharge end casing section 32. Mounted at the opposite ends of the casing 22 are a suction connection 34 and a discharge connection 36.

The suction end casing section 24 presents a planar radial wall portion or inlet side 38 and an outlet side 40. The casing section 24 is formed with an upper inlet port 42 which is open at the inlet side 38 and which merges with a generally arcuate channel 44 open at the outlet side 40. The casing section 24 is also formed with a central axial opening 46, and lower mounting feet 48. Projecting from the inlet side 38 is a radially inner axial annular flange 50, and projecting from the outlet side 40 is a radially outer axial annular flange 52.

As shown in FIGS. 3 and 10, the first-stage casing ring 26 presents an inlet side 54, an outlet side 56, and an interior cylindrical surface 58. The casing ring 26 is formed with three upper axial-through cutouts 60, 62 and 64 in the surface 58, and a center circumferential baffle web 66 extends across the cutout 62. The casing ring 26 is also formed with a center radial collar 68, a radially outer annular recess 70 at the inlet side 54, and a radially outer annular recess 72 at the outlet side 56. The inlet side 54 of the casing ring 26 abuts the outlet side 40 of the casing section 24, the casing ring recess 70 receives the casing section flange 52 with a seal ring 74 interposed therebetween, and the cutouts 62 and 64 communicate with the casing section inlet port 42 and channel 44.

Figure 7:
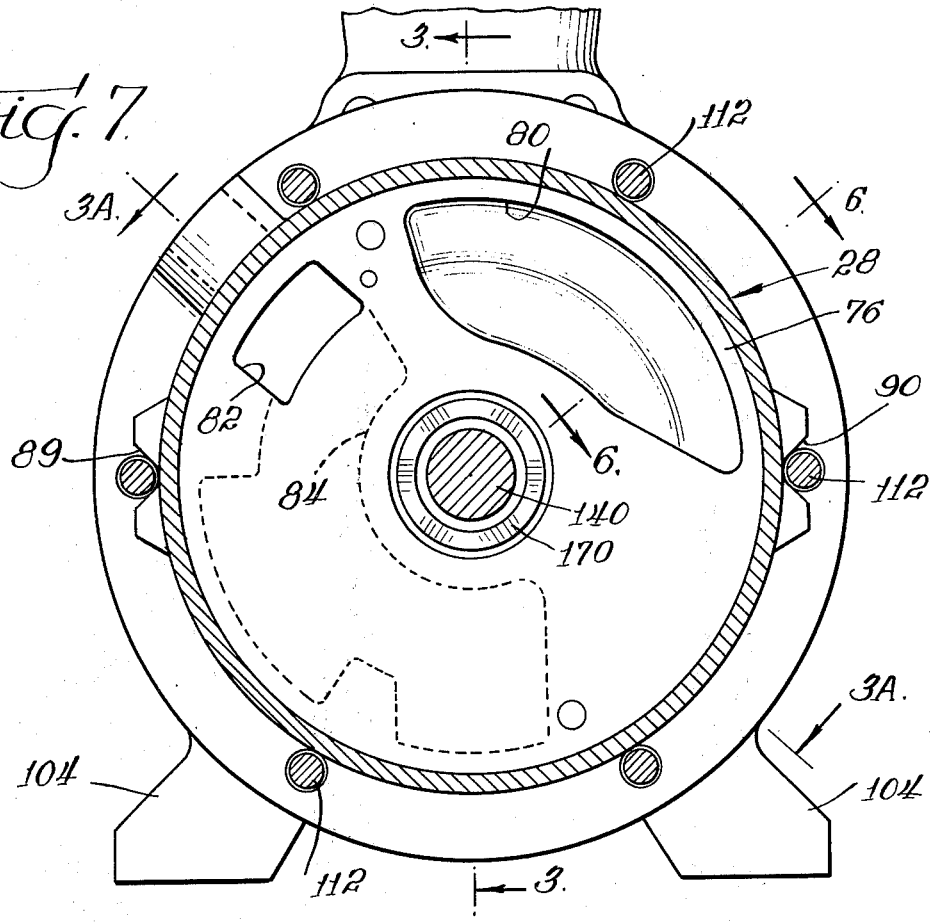
FIG. 7 is a transverse sectional view taken substantially along the lines 7—7 in FIGS. 3, 4 and 5 looking in the direction indicated by the arrows.
Figure 6:
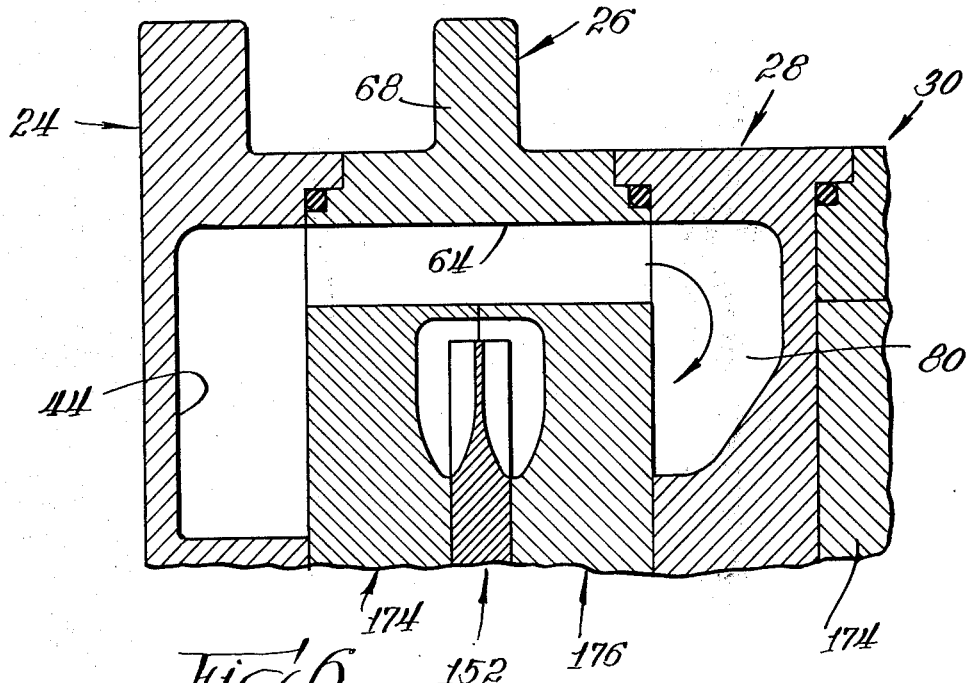
FIG. 6 is a sectional view taken substantially along the line 6—6 in FIGS. 7 and 10 looking in the direction indicated by the arrows.

As shown in FIGS. 3 and 7, the transfer plate 28 presents an inlet side 76 and an outlet side 78. The plate 28 is formed with a generally arcuate channel 80 open at the inlet side 76, and an axial-through opening 82 merging with a generally arcuate channel 84 open at the outlet side 78. The plate 28 is also formed with a radially outer axial annular flange 86 at the inlet side 76, a radially outer axial annular flange 88 at the outlet side 78, and opposed radial locating lugs 89 and 90. The inlet side 76 of the transfer plate 28 abuts the outlet side 56 of the casing ring 26, the transfer plate flange 86 is received in the casing ring recess 72 with a seal ring 91 interposed therebetween, the transfer plate channel 80 communicates with the casing ring cutouts 62 and 64, and the transfer plate opening 82 communicates with the casing ring cutout 60 (FIG. 3A).

The second-stage casing ring 30 (FIGS. 3 and 3A) is identical in construction to the first-stage casing ring 26, but is positioned 180° out of phase with the latter. With respect to the second-stage casing ring 30, the inlet side 54 abuts the outlet side 78 of the transfer plate 28, the casing ring recess 70 receives the transfer plate flange 88 with a seal ring 92 interposed therebetween, and the cutouts 62 and 64 communicate with the transfer plate channel 84.

Figure 9:
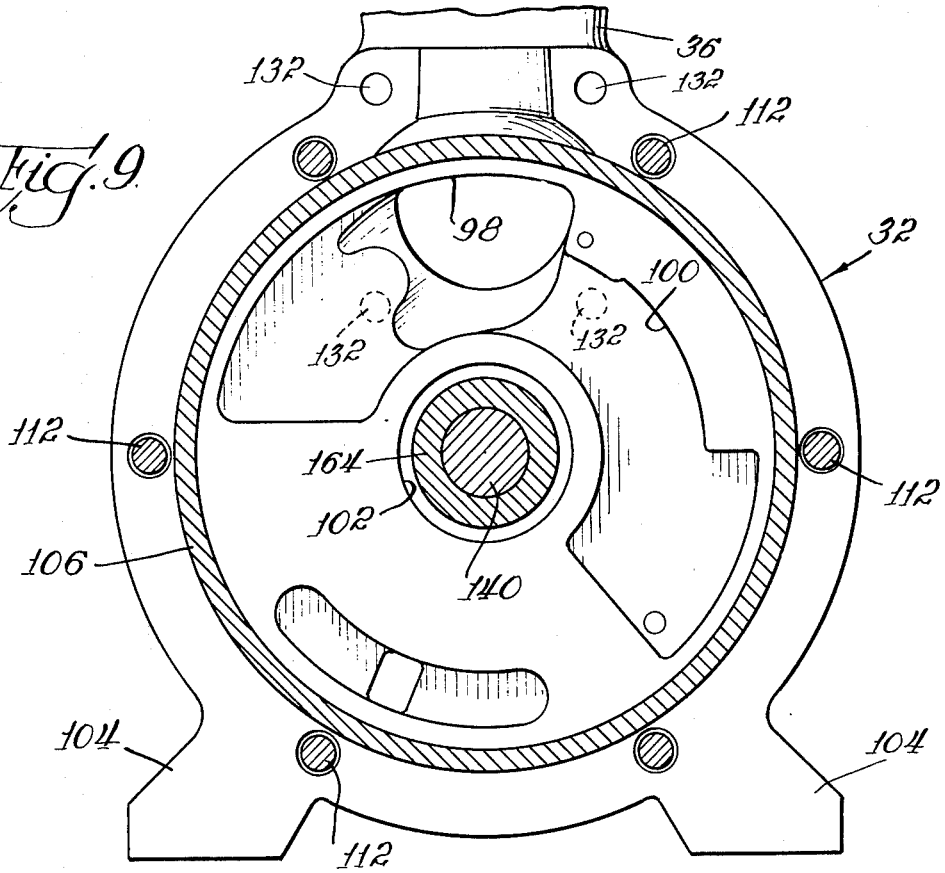
FIG 9 is a transverse sectional view taken substantially along the lines 9—9 in FIGS. 3, 4 and 5 looking in the direction indicated by the arrows.

The discharge end casing section 32, which is similar to the suction end casing section 24, presents an inlet side 94 and a planar radial wall portion or outlet side 96. The casing section 32, as shown in FIGS. 3, 3A and 9, is formed with an upper outlet port 98 which is open at the outlet side 96 and which merges with a generally arcuate channel 100 open at the inlet side 94. The casing section 32 is also formed with a central axial opening 102, and lower mounting feet 104. Projecting from the inlet side 94 is a radially outer axial annular flange 106 and projecting from the outlet side 96 is a radially inner axial annular flange 108. The inlet side 94 of the casing section 32 abuts the outlet side 56 of the casing ring 30, the casing section flange 106 is received in the recess 72 of the casing ring 30 with a seal ring 110 interposed therebetween, and the casing section channel 100 communicates with the cutout 60 of the casing ring 30 (FIG. 3A).

The elements of the casing 22 are maintained in assembled relation by a plurality of longitudinally extending circumferentially spaced apart bolts 112 which project through the collars 68 of the casing rings 26 and 30 and through the end casing sections 24 and 32.

As shown in FIG. 3, the suction connection 34 has a generally radial bore 114 presenting an outer threaded end 116 and an inner side opening 118 open at a planar radial wall portion 119. The connection 34 is secured to the casing section 24 by bolts 120 with a seal ring 122 interposed therebetween, the inner side opening 118 communicates with the inlet port 42, and the outer end 116 threadingly receives an inlet pipe 124. Correspondingly, the discharge connection 36 has a generally radial bore 126 presenting an outer threaded end 128 and an inner side opening 130 at a planar radial wall portion 131. The connection 36 is secured to the casing section 32 by bolts 132 with a seal ring 134 interposed therebetween, the inner side opening 130 communicates with the outlet port 98, and the outer end 128 threadingly receives an outlet pipe 136.

Extending axially through the casing 22 is a shaft 138 having an intermediate body section 140, a pair of seal sections 142 and 144 of reduced diameter, a pair of bearing sections 146 and 148 of further reduced diameter, and a drive end section 150 of still further reduced diameter adapted to be connected with a drive motor (not shown).

Keyed to the shaft 138 within the confines of the casing ring 26 is a first-stage turbine-type impeller 152 (FIGS. 14 and 15) having a hub portion 154, and keyed to the shaft 138 within the confines of the casing ring 30 is an identical but reversely oriented second-stage impeller 156 having a hub portion 158. Located at the outboard side of the impeller hub portion 154 is a lock collar 160, located intermediate of the impeller hub portions 154 and 158 is a lock collar 162, and located at the outboard side of the impeller hub portion 158 is a lock collar 164. Each lock or impeller-locating collar 160, 162 and 164 is held in place by a set screw 166 engaged with a flat 168 formed on the periphery of the shaft body section 140. In addition, spring washers 170 and 172 are respectively interposed between the impeller hub portion 154 and the lock collar 162, and between the impeller hub portion 158 and the lock collar 164.

Mounted intermediate of the suction end casing section 24 and the first-stage impeller 152 is a first generally annular liner 174, and mounted intermediate of the impeller 152 and the transfer plate 28 is a second generally annular liner 176. The first liner 174, as shown in FIG. 12, is formed with radial notches 178 and 180 interconnected by an annular groove 182, and with a radially outer annular flange 184. The second liner 176, as shown in FIG. 13, is substantially a mirror image of the liner 174. It, too, is formed with radial notches 186 and 188 interconnected by an annular groove 190, and with a radially outer annular flange 192. The pairs of notches 178, 180 and 186, 188 are respectively circumferentially aligned, the liners 174 and 176 are seated in the casing ring 26, the flanges 184 and 192 abut radially spaced outwardly of the periphery of the impeller 152, the notches 178, 186 communicate with the end casing section channel 44 and the transfer plate channel 80, and the notches 180, 188 communicate with the transfer plate opening 82.

Mounted intermediate of the transfer plate 28 and the second-stage impeller 156 is a first generally annular liner 194, and mounted intermediate of the impeller 156 and the discharge end casing section 32 is a second generally annular liner 196. The second-stage liners 194 and 196 are respectively identical in construction to the firststage liners 174 and 176, but are positioned 180° out of phase with the latter. With respect to the second-stage liners 194 and 196, the pairs of notches 178, 180 and 186, 188 are respectively circumferentially aligned, the liners 194 and 196 are seated in the casing ring 30, the flanges 184 and 192 abut radially spaced outwardly of the periphery of the impeller 156, the notches 178, 186 communicate with the transfer plate channel 84, and the notches 180, 188 communicate with the end casing section channel 100.

A seal ring 198 is interposed between the suction end casing section 24 and the liner 174; and seal ring 200 is interposed between the transfer plate 28 and the liner 194. For ease of machining and assembly, the thickness of each pair of liners is maintained a few thousandths of an inch less than the thickness of the associated casing ring. The seal rings 198 and 200 serve to compensate for such differences in thickness.

Figure 4A:
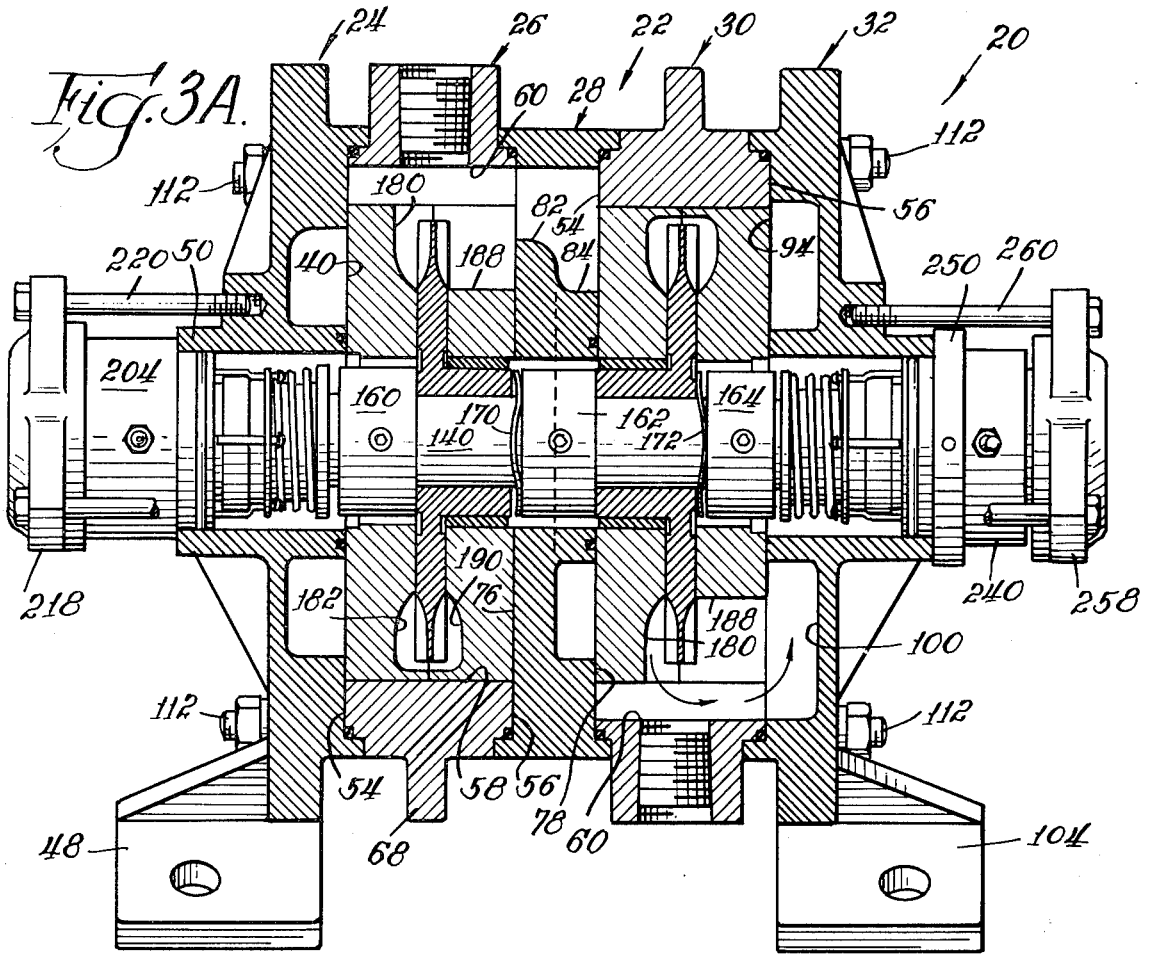
FIG. 4A is a sectional view of another modified embodiment of suction connection.
Figure 4A:
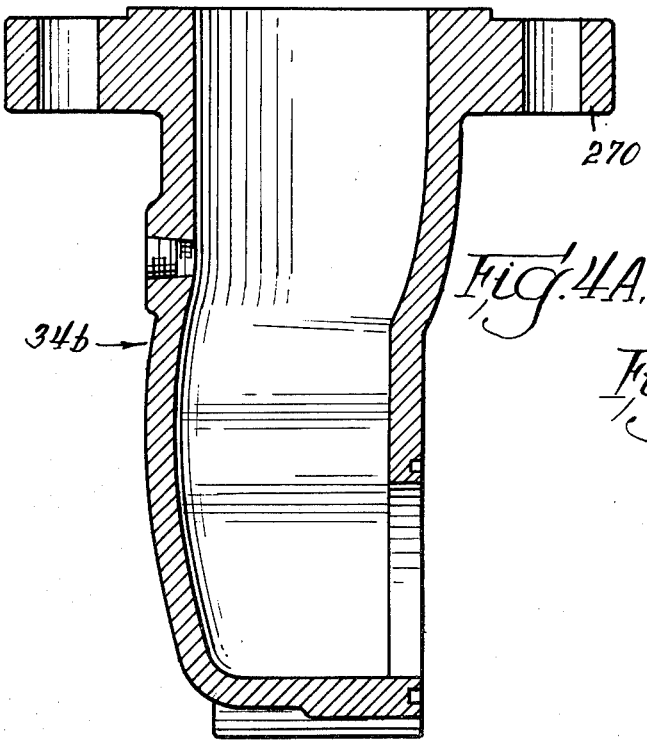
Figure 4B:
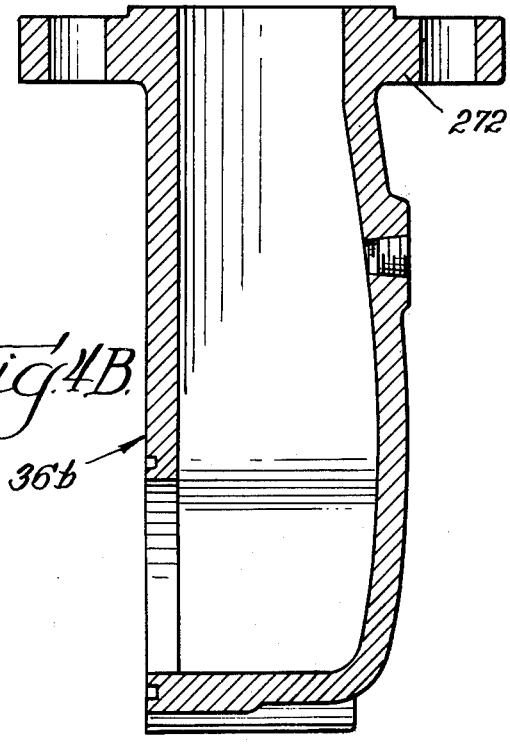
FIG. 4B is a sectional view of another modified embodiment of discharge connection.
Figure 4:
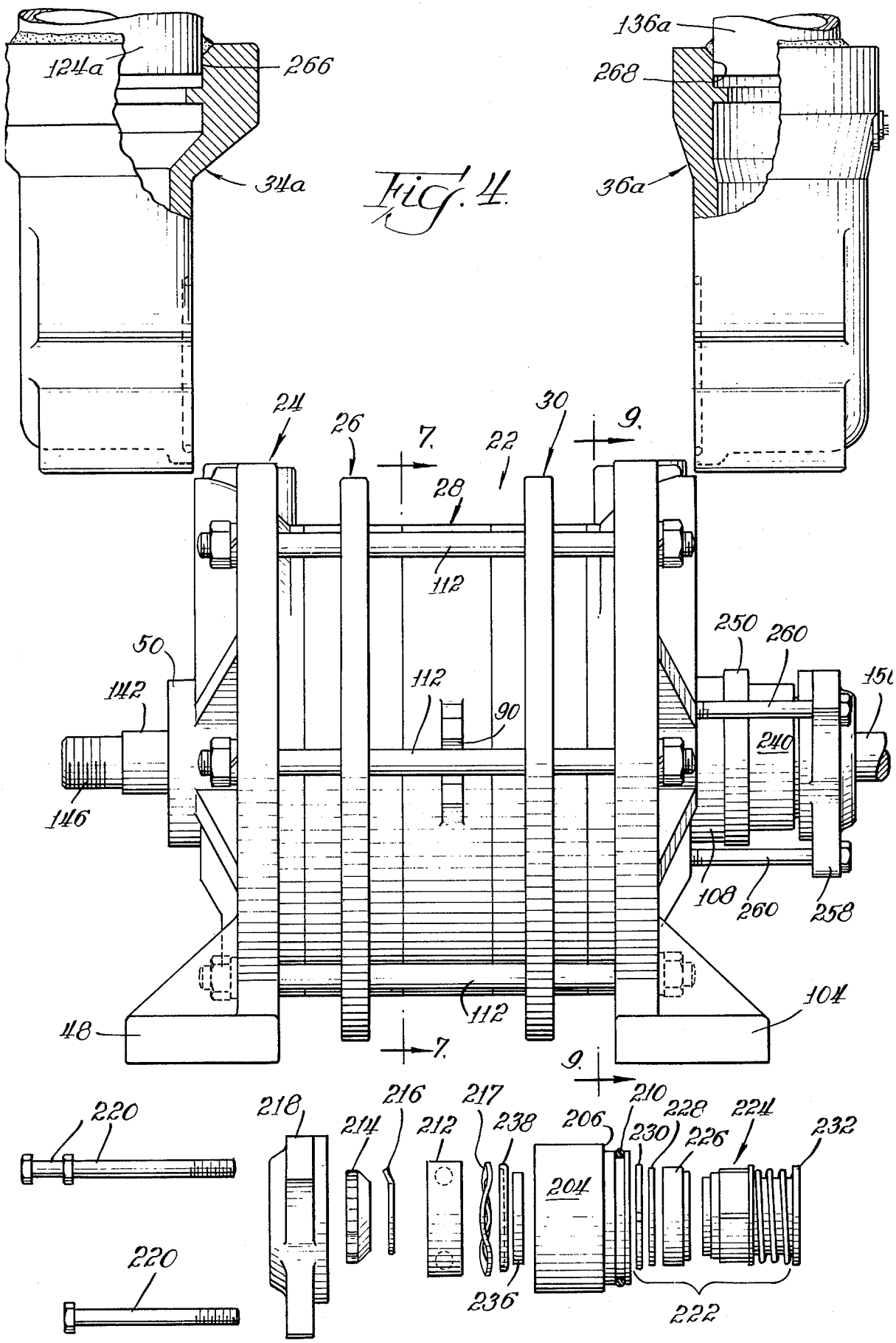
FIG. 4 is a longitudinal elevational view of a two-stage pump in a partially disassembled condition, shows an exploded longitudinal elevational view of one of the demountable bearing assemblies, and shows modified embodiments of suction and discharge connections.

As shown in FIGS. 3 and 4, the bearing and seal mounting of the suction end of the shaft 138 comprises an annular bearing cartridge 204 presenting an external shoulder 206 and an internal shoulder 208. The inner end of the bearing cartridge 204 projects into the casing section opening 46 with a seal ring 210 interposed therebetween and with the shoulder 206 abutting the casing section flange 50. Arranged between the bearing cartridge 204 and the shaft bearing section 146 is a ball bearing unit 212 which is held against the shaft seal section 142 by a lock nut 214 and a lock washer 216. Mounted inboard of the ball bearing unit 212 is a spring washer 217. A cap member 218 abuts the outer end of the bearing cartridge 204, and bolts 220 secure the cap member 218 to the suction end casing section 24 for maintaining the bearing cartridge 204 in position. Also arranged between the bearing cartridge 204 and the shaft seal section 142 are seal means 222 which include a rotating seal unit 224, a seal seat 226, and a backup ring 228. These elements are axially located between a snap ring 230 which is retained in the bearing cartridge 204 and a sleeve 232 which is held in abutment with the shaft body section 140 by a snap ring 234. Disposed inwardly of the ball bearing unit 212 are a water slinger 236 and an inner housing cap 238.

Figure 16:
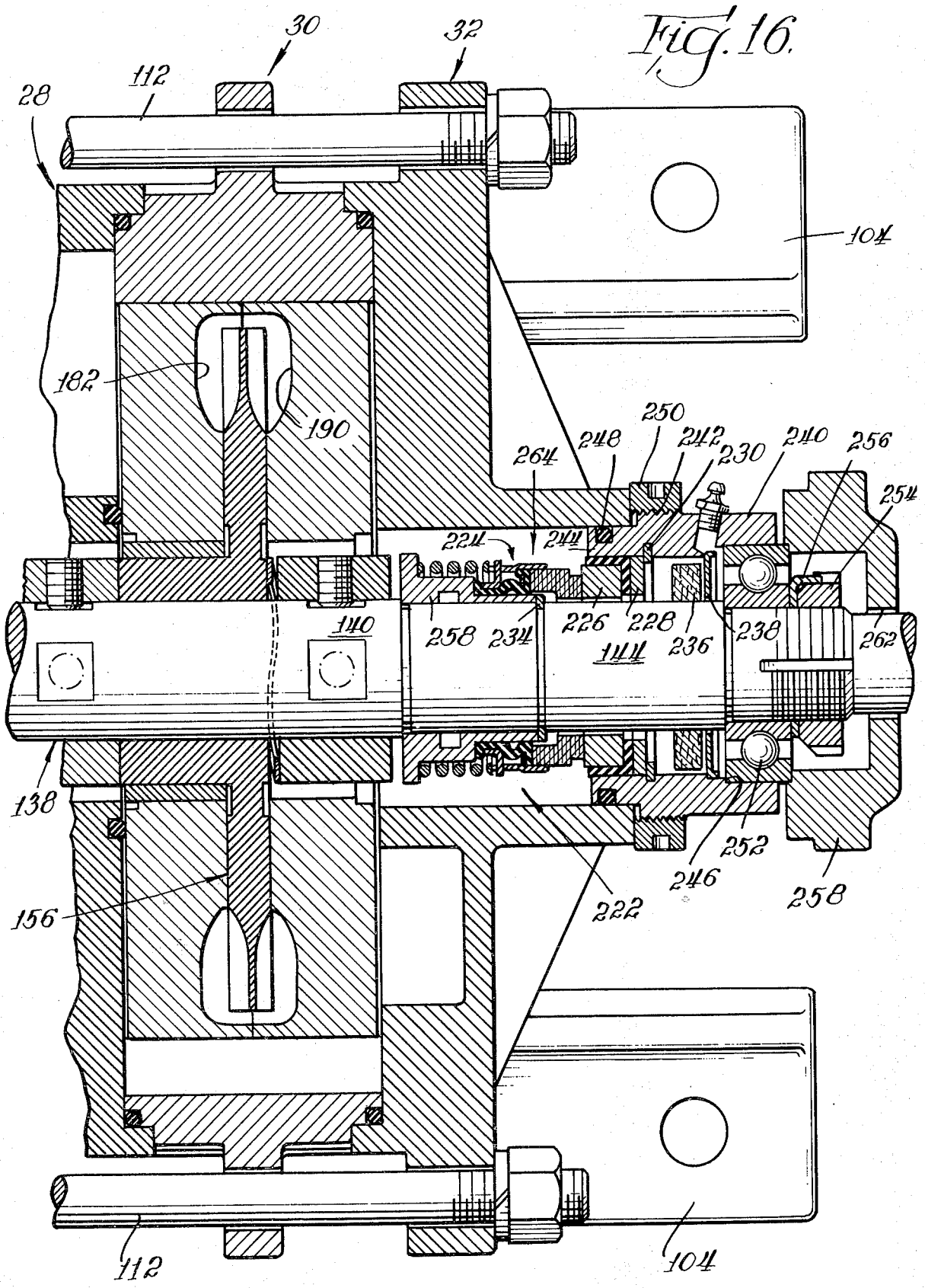
FIG. 16 is a partial longitudinal sectional view taken substantially along the line 16—16 in FIG. 3 looking in the direction indicated by the arrows.

As shown in FIGS. 3 and 16, the bearing end seal mounting on the discharge end of the shaft 138 comprises an annular bearing cartridge 240 presenting an externally threaded portion 242, an inner end 244 of reduced diameter, and an internal shoulder 246. The inner end 244 projects into the casing section opening 102 with a seal ring 248 interposed therebetween and an adjusting ring 250 is threaded on the threaded portion 242 and abuts the casing section flange 108. Arranged between the bearing cartridge 240 and the shaft bearing section 148 is a ball bearing unit 252 which is held against the shaft seal section 144 by a lock nut 254 and a lock washer 256. A cap member 258 abuts the ball bearing unit 252 which in turn abuts the shoulder 246, and bolts 260 secure the cap member 258 to the discharge end casing section 32 for maintaining the bearing cartridge 240 in position. The cap member 258 is provided with a central axial aperture 262 through which the shaft drive end section 150 projects. Also arranged between the bearing cartridge 240 and the shaft seal section 144 are seal means 264 which are identical to the seal means 222 but reversely oriented.

During assembly of the pump 20, the lock collar 164 is axially preset on the shaft 138, with the lock collars 160 and 162 serving to axially locate the impellers 152 and 156 relative to the shaft 138. The spring washers 170 and 172 maintain the impellers 152 and 156 in engagement with the lock collars 160 and 162, and yet allow emergency shifting of the impellers. Prior to securing of the cap member 258 in place, the adjustable ring 250 is rotated to adjust the axial position of the bearing cartridge 240, shaft 138, and impellers 152 and 156, relative to the casing 22. When the cap member 258 is secured in place, it maintains the bearing cartridge 240, shaft 138, and impellers 152 and 156, in the axially adjusted position. The spring washer 217 takes up bearing end play and prevents bearing skidding. The described positive location of the impellers 152 and 156 relative to the shaft 138 by collars and spring washers minimizes wear of the impellers and liners, and the overall mounting of the impellers and shaft facilities assembly and axial adjustment of the latter.

Referring to FIGS. 3 and 3A, when the shaft 138 and impellers 152 and 156 are rotating, the pump 20 operates as follows: First, fluid is admitted through the suction connection 34 and the suction end casing section 24; it flows through the bore 114, side opening 118, inlet port 42 and channel 44. Then, the fluid enters the periphery of the first pump stage, wherein a differential pressure is developed, and exits at the periphery adjacent the point of entrance; it flows within the cutouts 62 and 64 and channel 80, is drawn by the impeller 152 into the notches 178, 186 and the grooves 182, 190, and is directed outwardly of the notches 180, 188. The cutout 64, in conjunction with the cutout 62, serves to balance the flow of entering fluid to each of the liners 174 and 176, while the cutout 60 accommodates the flow of exiting fluid. Next, the fluid moves through the transfer plate 28 to a circumferential position 180° out of phase with respect to the entrance of the first pump stage; it flows through the opening 82 and the channel 84. Thereafter, the fluid enters the periphery of the second pump stage, wherein a differential pressure is further developed, and exits at a circumferential position 180° out of phase with respect to the exit of the first pump stage; it flows within the cutouts 62 and 64, is drawn by the impeller 156 into the notches 178, 186 and grooves 182, 190, and is directed outwardly of the notches 180, 188. Finally, the fluid is discharged through the discharge end casing section 32 and the discharge connection 36; it flows through the channel 100, outlet port 98, side opening 130 and bore 126.

The bearing and seal mountings (FIG. 3) at the ends of the shaft 138 facilitate not only initial assembly of the pump 20 but also replacement of the bearings and seals. For example, at the suction end of the shaft 138, removable of the bolts 220 and lock nut 214 permits the cap member 218, bearing cartridge 204, ball bearing unit 212 and seal means 222 to be withdrawn from the end of the shaft (and suitable replacements made) without disturbing any other elements of the pump. The suction-end bearing and seal means are shown removed in FIG. 4. Correspondingly, at the discharge end of the shaft 138, removal of the bolts 260 and lock nut 254 permits the cap member 258, bearing cartridge 240, ball bearing unit 252 and seal means 264 to be withdrawn from the end of the shaft (and suitable replacements made) without disturbing any other elements of the pump.

The provision of suction and discharge connections which are separate from the other elements of the pump 20 facilitates not only initial assembly of the pump but also mounting of the same. For example, as shown in FIGS. 1 and 2, each suction and discharge connection 34 and 36 may be secured to the adjacent end casing section in any one of three rotative positions (upwardly or laterally to either side). This arrangement accommodates a variety of installation orientations and minimizes installation space. Also, separate suction and discharge connections accommodates the use of different types of pipe-coupling arrangements. As previously described, the connections 34 and 36 threadingly receive the inlet and outlet pipes 124 and 136. As shown in FIG. 4, modified connections 34*a* and 36*a* are formed with sockets 266 and 268 which receive inlet and outlet pipes 124*a* and 136*a* that are welded therein. As shown in FIGS. 4A and 4B, other modified connections 34*b* and 36*b* are provided with flanges 270 and 272 which are adapted to be bolted and/or welded to pipe flanges at the end of inlet and outlet pipes (not shown). Additionally, removal of the connection bolts 120 and 132 permits the pump casing 22 (and pump elements assembled therewith) to be withdrawn radially from between the suction and discharge connections while the latter remain coupled to inlet and outlet pipes as shown in FIG. 4. This arrangement allows the pump to be demounted, repaired or adjusted, and remounted, without disturbing the connection-to-pipe couplings. Although the suction-end bearing and seal means are shown removed in FIG. 4, they need not be removed to allow demounting of the pump from the suction and discharge connections.

It will be appreciated that the end casing sections, casing rings, transfer plate, and liners are of simple design with no complicated cores, and may be readily cast and/or machined with practical tolerances. Moreover, the provision of modular components simplifies inventory when different pump models—that is, different pumps with varying mumbers of stages—are involved, and allows the use of common components in the assembly of different pump models.

Figure 5:
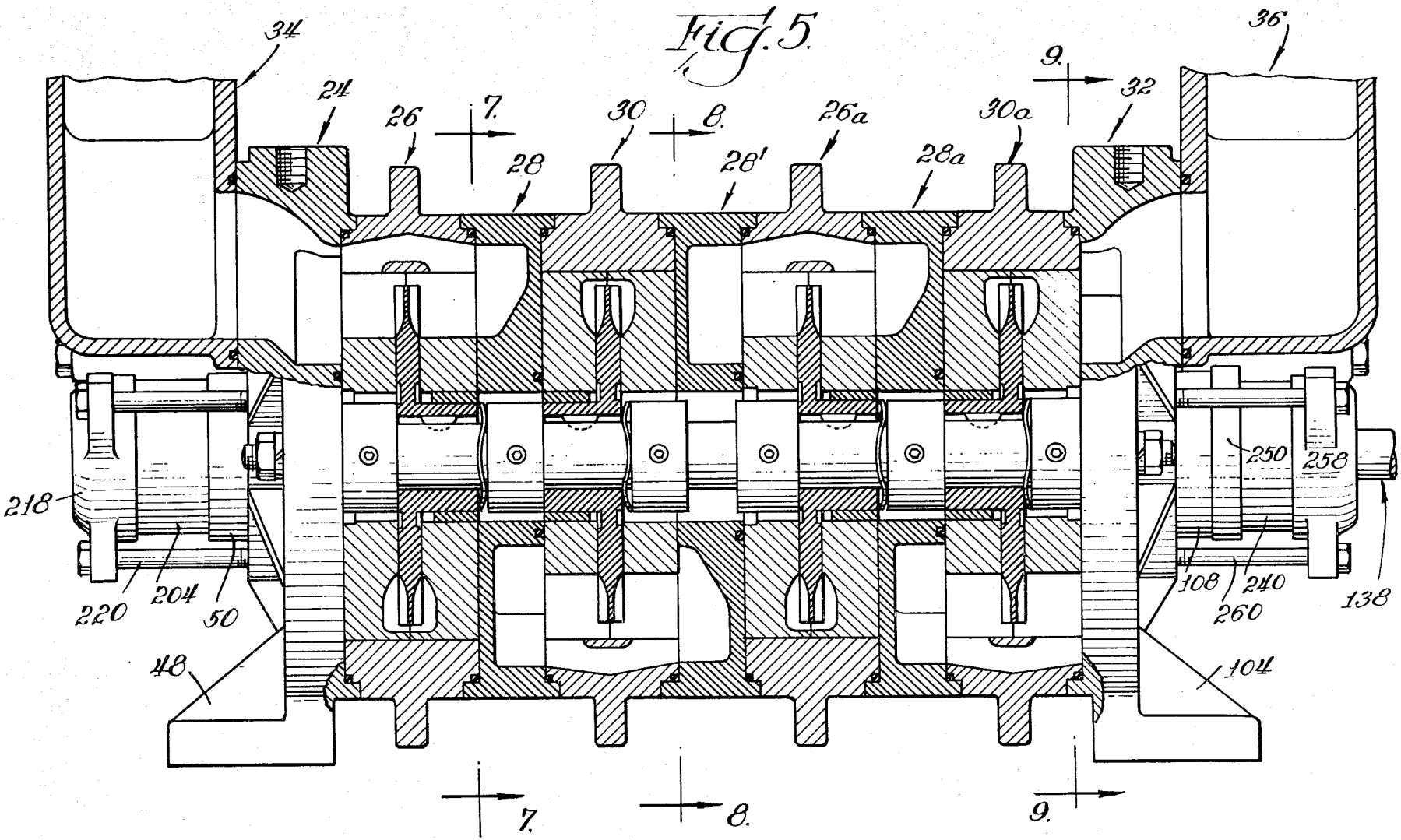
FIG. 5 is a longitudinal sectional view of a four-stage pump.
Figure 8:
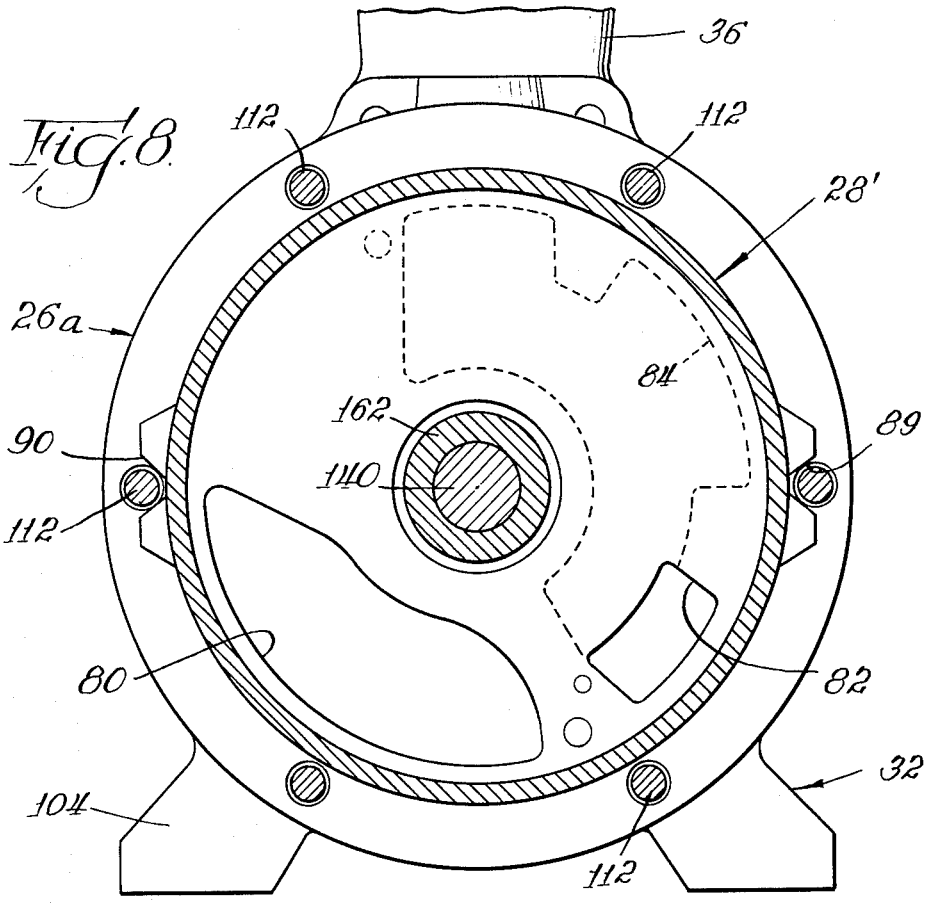
FIG. 8 is a transverse sectional view taken substantially along the line 8—8 in FIG. 5 looking in the direction indicated by the arrows.
Figure 18:
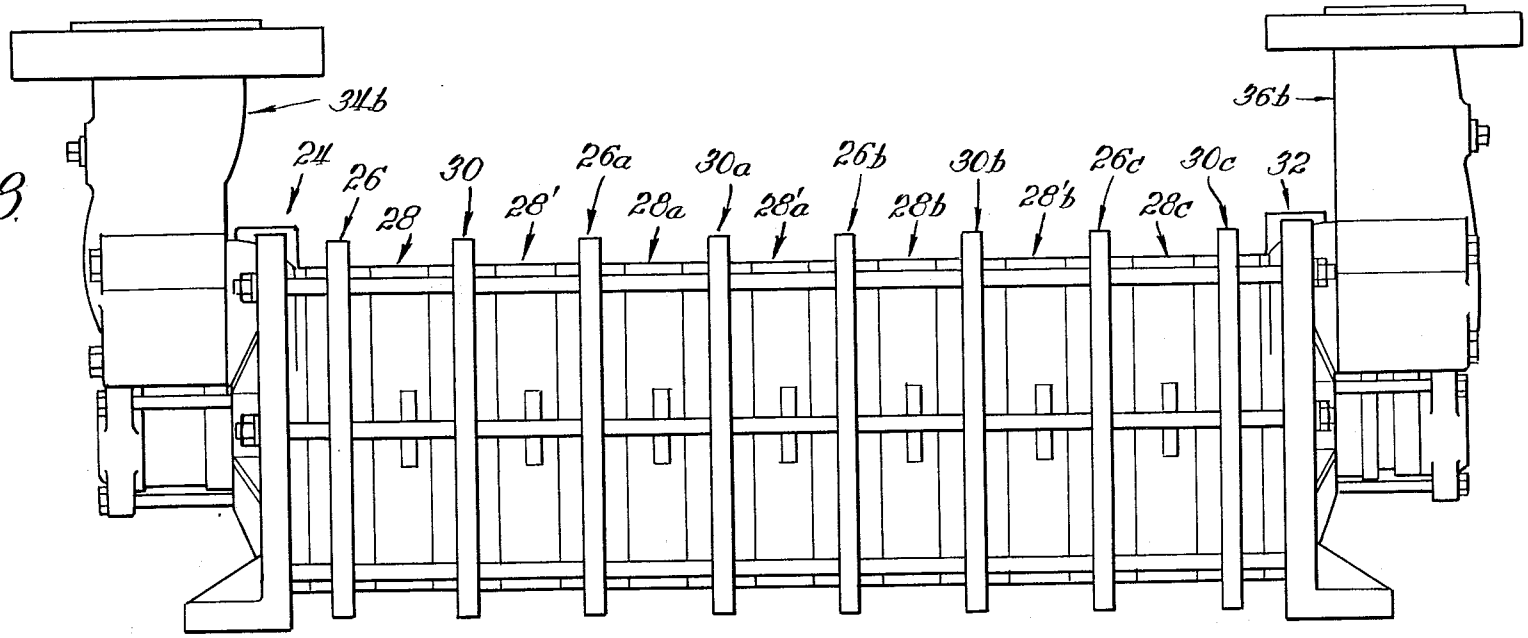
FIG. 18 is a longitudinal elevational view of an eight-stage pump.
Figure 17:
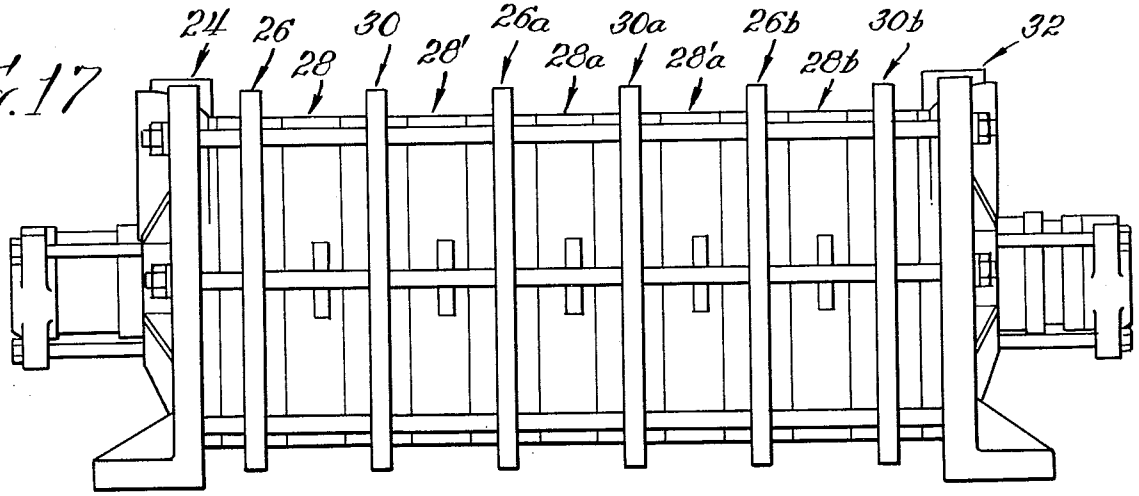
FIG. 17 is a longitudinal elevational view of a six-stage pump.

For example, shown in FIG. 5 is a four-stage pump, shown in FIG. 17 is a six-stage pump, and shown in FIG. 18 is an eight-stage pump. The casing rings 26*a—c*are identical in construction and orientation to the casing ring 26, while the casing rings 30*a–c* are identical in construction and orientation to the casing ring 30. The transfer plate 28′ is identical in construction to the transfer plate 28, but is positioned 180° out of phase with respect to the latter (compare FIGS. 7 and 8); the transfer plates 28*a–c* are identical in construction and orientation to the transfer plate 28; and the transfer plates 28′*a–b* are identical in construction and orientation to the transfer plate 28′. The liners within the casing rings 26*a–c* are identical in construction and orientation to the liners within the casing ring 26, while the liners within the casing rings 30*a–c* are identical in construction and orientation to the liners in the casing ring 30. With the principal exception of the shafts and casing bolts (which vary in length), all components of even-stage pumps over two stages are common to the components of a two-stage pump. Each associated casing ring, impeller, set of liners, locating collar, and spring means, together comprise a module which functions as one stage of the pump.

In all pumps, the exit of the fluid passageway means of each transfer plate is located X° out of phase with respect to the entrance of the fluid passageway means of the earlier-stage liners, and the exit of the fluid passageway means of each later-stage liners is located X° out of phase with respect to the exit of the fluid passageway means of the earlier-stage liners. In even-stage pumps, X is equal to 180; in odd-stage pumps, X is equal to 360 divided by the number of stages. Thus, the forces acting on the fluid are radially balanced.

The stages of each pump are connected in series, and the differential pressure developed in each stage is substantially uniform. Hence, the total differential pressure developed by a pump with a given number of stages is approximately equal to the differential pressure developed in one stage multiplied by the number of stages.

While there have been shown and described preferred embodiments of the present invention, it will be understood by those skilled in the art that various rearrangements and modifications may be made therein without departing from the spirit and scope of the invention.

The invention claimed is:

1. A multi-stage regenerative turbine pump comprising: a casing having a plurality of successive-stage casing rings, a transfer plate in intermediate abutment with each adjacent pair of said casing rings and having fluid passageway means presenting an entrance communicating with the interior of the earlier-stage casing ring and an exit communicating with the interior of the later-stage casing ring, a suction end casing section abutting the first-stage casing ring, a discharge end casing section abutting the last-stage casing ring, and means securing the aforesaid casing elements together; a shaft extending axially through said casing; an impeller within the confines of each of said casing rings and keyed to said shaft for rotation therewith; a locating collar secured to said shaft adjacent each of said impellers; spring means biasing each of said impellers into engagement with the adjacent of said locating collars; a pair of liners arranged at the opposite sides of each of said impellers; and each associated casing ring, impeller, pair of liners, locating collar, and spring means, together comprising a module which functions as one stage of the pump.

2. A multi-stage regenerative turbine pump comprising: a casing having a plurality of successive-stage casing rings, a transfer plate in intermediate abutment with each adjacent pair of said casing rings and having fluid passageway means presenting an entrance communicating with the interior of the earlier-stage casing ring and an exit communicating with the interior of the later-stage casing ring, a suction end casing section abutting the first-stage casing ring, a discharge end casing section abutting the last-stage casing ring, and means securing the aforesaid casing elements together; a shaft extending axially through said casing; and an impeller within the confines of each of said casing rings and secured to said shaft for rotation therewith.

3. The multi-stage regenerative turbine pump of claim 2 including a generally annular liner seated within each of said casing rings at one side of the associated impeller, and a generally annular liner seated within each of said casing rings at the other side of the associated impeller.

4. The multi-stage regenerative turbine pump of claim 3 wherein each pair of said liners within each-stage casing ring is formed with fluid passageway means presenting an entrance and an exit, wherein said exit of said fluid passageway means of each transfer plate is located X° out of phase with respect to said entrance of said fluid passageway means of the earlier-stage liners for balancing the forces acting on the fluid, and wherein for an even-stage pump X is equal to 180 and for an odd-stage pump X is equal to 360 divided by the number of stages.

5. The multi-stage regenerative turbine pump of claim 3 including a seal ring interposed between said suction end casing section and the adjacent liner, and a seal ring interposed between between each transfer plate and the adjacent liner of the succeeding stage, whereby to compensate for differences in thickness between each pair of liners and the associated casing ring.

6. The multi-stage regenerative turbine pump of claim 3 wherein said suction end casing section is formed with a fluid inlet, said discharge end casing section is formed with a fluid outlet, each pair of said liners within each-stage casing ring is formed with fluid passageway means presenting an entrance and an exit, said entrance of said fluid passageway means of the first-stage liners communicates with said fluid inlet, said exit of said fluid passageway means of the first-stage liners communicates with said entrance of said fluid passageway means of the adjacent transfer plate, said entrance of said fluid passageway means of each laterstage liners communicates with said exit of said fluid passageway means of the adjacent transfer plate, and said exit of said fluid passageway means of the last-stage liners communicates with said fluid outlet.

7. The multi-stage regenerative turbine pump of claim 6 wherein each of said casing rings is formed with inner radial cutouts which serve to balance the flow of entering fluid to each of the adjacent pair of said liners.

8. The multi-stage regenerative turbine pump of claim 6 wherein said exit of said fluid passageway means of each transfer plate is located 180° out of phase with respect to said entrance of said fluid passageway means of the earlier-stage liners, and said exit of said fluid passageway means of each laterstage liners is located 180° out of phase with respect to said exit of said fluid passageway means of the earlier stage liners.

9. The multi-stage regenerative turbine pump of claim 8 including a seal ring interposed between said suction end casing section and the adjacent liner, and a seal ring interposed between each transfer plate and the adjacent liner of the succeeding stage, whereby to compensate for differences in thickness between each pair of liners and the associated casing ring.

10. The multi-stage regenerative turbine pump of claim 2 wherein said suction end casing section is formed with a fluid inlet, and said discharge end casing section is formed with a fluid outlet; and including a suction connection having a side opening communicating with said fluid inlet, said suction connection being securable to said suction end casing section in any one of several predetermined rotative positions relative to said fluid inlet, a discharge connection having a side opening communicating with said fluid outlet, and said discharge connection being securable to said discharge end casing section in any one of several predetermined rotative positions relative to said fluid outlet.

11. The multi-stage regenerative turbine pump of claim 2 wherein said suction end casing section is formed with a fluid inlet open at a planar radial wall portion, and said discharge end casing section is formed with a fluid outlet open at a planar radial wall portion; and including a suction connection having a side opening open at a planar radial wall portion, means securing said suction connection to said suction end casing section with said side opening of said suction connection communicating with said fluid inlet, a discharge connection having a side opening open at a planar radial wall portion, means securing said discharge connection to said discharge end casing section with said side opening of said discharge connection communicating with said fluid outlet, and said securing means being removable to permit said casing to be withdrawn radially from between said suction and discharge connections.

12. A regenerative turbine pump comprising a casing having a fluid inlet at one end and a fluid outlet at the other end, a suction connection having a side opening communicating with said fluid inlet, means securing said suction connection to said casing in any one of several predetermined rotative positions relative to said fluid inlet, a discharge connection having a side opening communicating with said fluid outlet, and means securing said discharge connection to said casing in any one of several predetermined rotative positions relative to said fluid outlet.

13. The regenerative turbine pump of claim 12 wherein said fluid inlet is open at a planar radial wall portion, said fluid outlet is open at a planar radial wall portion, said side opening of said suction connection is open at a planar radial wall portion, said side opening of said discharge connection is open at a planar radial wall portion, and said securing means are removable to permit said casing to be withdrawn radially from between said suction and discharge connections.

14. The multi-stage regenerative turbine pump of claim 2 including a first collar secured to said shaft and abutting one side of one of said impellers for axially locating the latter, a second collar secured to said shaft adjacent the other side of said one impeller, and spring means interposed between said second collar and said other side of said one impeller for maintaining said one impeller in engagement with said first collar.

15. The multi-stage regenerative turbine pump of claim 14 wherein said suction end casing section has a central axial opening through which one end of said shaft projects, said discharge end casing section has a central axial opening through which the other end of said shaft projects, and said shaft presents external shoulder means at said other end thereof; and including a first annular bearing cartridge having a shoulder abutting said suction end casing section adjacent said central axial opening thereof, first bearing means and first seal means arranged intermediate of said first bearing cartridge and said shaft, a first cap member at the outer end of said first bearing cartridge, first securing means securing said first cap member to said suction end casing section for maintaining said first bearing cartridge in position, said first securing means being removable to permit said first cap member and said first bearing cartridge and said first bearing and seal means to be withdrawn from said one end of said shaft without disturbing any other of the aforesaid elements of said pump, a second annular bearing cartridge adjacent said central axial opening of said discharge end casing section and having an externally threaded portion and internal shoulder means, an adjusting ring threaded on said threaded portion and abutting said discharge end casing section, second bearing means and second seal means arranged intermediate of said second bearing cartridge and said shaft with said second bearing means abutting said external and internal shoulder means, said adjusting ring being rotatable to adjust the axial position of said second bearing cartridge and said shaft relative to said casing, a second cap member at the outer end of said second bearing cartridge and abutting said second bearing means, second securing means securing said second cap member to said discharge end casing section for maintaining said second bearing cartridge and said shaft in axially adjusted position, and said second securing means being removable to permit said second cap member and said second bearing cartridge and said second bearing and seal means to be withdrawn from said other end of said shaft without disturbing any other of the aforesaid elements of said pump.

16. The multi-stage regenerative turbine pump of claim 2 wherein said suction end casing section has a central axial opening through which one end of said shaft projects, said discharge end casing section has a central axial opening through which the other end of said shaft projects, and said shaft presents external shoulder means at said other end thereof; and including a first annular bearing cartridge having a shoulder abutting said suction end casing section adjacent said central axial opening thereof, first bearing means and first seal means arranged intermediate of said first bearing cartridge and said shaft, a first cap member at the outer end of said first bearing cartridge, first securing means securing said first cap member to said suction end casing section for maintaining said first bearing cartridge in position, said first securing means being removable to permit said first cap member and said first bearing cartridge and said first bearing and seal means to be withdrawn from said one end of said shaft without disturbing any other of the aforesaid elements of said pump, a second annular bearing cartridge adjacent said central axial opening of said discharge end casing section and having an externally threaded portion and internal shoulder means, an adjusting ring threaded on said threaded portion and abutting said discharge end casing section, second bearing means and second seal means arranged intermediate of said second bearing cartridge and said shaft with said second bearing means abutting said external and internal shoulder means, said adjusting ring being rotatable to adjust the axial position of said second bearing cartridge and said shaft relative to said casing, a second cap member at the outer end of said second bearing cartridge and abutting said second bearing means, second securing means securing said second cap member to said discharge end casing section for maintaining said second bearing cartridge and said shaft in axially adjusted position, and said second securing means being removable to permit said second cap member and said second bearing cartridge and said second bearing and seal means to be withdrawn from said other end of said shaft without disturbing any other of the aforesaid elements of said pump.

17. A regenerative turbine pump comprising a casing, a shaft extending axially through said casing, at least one impeller within said casing and keyed to said shaft for rotation therewith, a first collar secured to said shaft and abutting one side of said impeller for axially locating the latter, a second collar secured to said shaft adjacent the other side of said impeller, and spring means interposed between said second collar and said other side of said impeller for maintaining said impeller in engagement with said first collar.

18. The regenerative turbine pump of claim 17 wherein one end of said casing has a central axial opening through which one end of said shaft projects, and the other end of said casing has a central axial opening through which the other end of said shaft projects; and including an annular bearing cartridge abutting said one end of said casing adjacent said central axial opening thereof, bearing means and seal means arranged intermediate of said bearing cartridge and said shaft, a cap member at the outer end of said bearing cartridge, means securing said cap member to said casing for maintaining said bearing cartridge in position, and said securing means being removable to permit said cap member and said bearing cartridge and said bearing and seal means to be withdrawn from said one end of said shaft without disturbing any other of the aforesaid elements of said pump.

19. The regenerative turbine pump of claim 18 including a second annular bearing cartridge adjacent said central axial opening of said other end of said casing and having an externally threaded portion, an adjusting ring threaded on said threaded portion and abutting said other end of said casing, second bearing means and second seal means arranged intermediate of said second bearing cartridge and said shaft, said adjusting ring being rotatable to adjust the axial position of said second bearing cartridge and said shaft relative to said casing, a second cap member at the outer end of said second bearing cartridge, second securing means securing said second cap member to said other end of said casing for maintaining said second bearing cartridge and said shaft in axially adjusted position, and said second securing means being removable to permit said second cap member and said second bearing cartridge and said second bearing and seal means to be withdrawn from said other end of said shaft without disturbing any other of the aforesaid elements of said pump.

* * * * *